US010710775B2

(12) United States Patent
Kessell et al.

(10) Patent No.: US 10,710,775 B2
(45) **Date of Patent: *Jul. 14, 2020**

(54) CONTAINER WITH CONCERTINA SIDE WALLS AND BASE

(71) Applicant: Tarvis Technology Limited, Auckland (NZ)

(72) Inventors: Michael Ross Kessell, Auckland (NZ); Charles Graeme Murray, Auckland (NZ)

(73) Assignee: TARVIS TECHNOLOGY LIMITED, Auckland (NZ)

( * ) Notice: Subject to any disclaimer, the term of this patent is extended or adjusted under 35 U.S.C. 154(b) by 0 days.

This patent is subject to a terminal disclaimer.

(21) Appl. No.: 15/619,594

(22) Filed: Jun. 12, 2017

(65) Prior Publication Data

US 2018/0370689 A1 Dec. 27, 2018

Related U.S. Application Data

(63) Continuation of application No. 15/000,967, filed on Jan. 19, 2016, which is a continuation of application (Continued)

(30) Foreign Application Priority Data

Dec. 23, 2004 (NZ) ..... 537514
Aug. 23, 2005 (NZ) ..... 541985

(51) Int. Cl.
*B65D 35/08* (2006.01)
*B65D 1/40* (2006.01)

(Continued)

(52) U.S. Cl.
CPC ..... *B65D 35/08* (2013.01); *B65D 1/32* (2013.01); *B65D 1/40* (2013.01); *B65D 21/086* (2013.01); *B65D 25/04* (2013.01); *B65D 35/22* (2013.01)

(58) Field of Classification Search
CPC combination set(s) only.
See application file for complete search history.

(56) References Cited

U.S. PATENT DOCUMENTS 972,095 A * 10/1910 Booth ..... 222/92
1,738,779 A 12/1929 Lockwood (Continued)

FOREIGN PATENT DOCUMENTS

CN 2036772 U 5/1989
CN 2250933 Y 4/1997

(Continued)

*Primary Examiner* — Kareen K Thomas
(74) *Attorney, Agent, or Firm* — Jacobson Holman, PLLC.

(57) ABSTRACT

A collapsible container or reservoir including at least one side wall region (4-7) and a basal wall region or base (8) surrounding a containment region having an upper opening or mouth (10) surrounded by a perimeter flange (9) at the ends of the side walls distal from the basal wall region, the side walls include a region of concertina (14) whereby, upon squeezing or compression of the side walls, the basal wall region of the container is compacted more, relative to the extent of the upper opening. The container can be used for dispensing foods such as pet food, sauces, yoghurt, custard or the like, or other liquids or semi fluid materials such as oil, grease, glue or resin.

20 Claims, 11 Drawing Sheets

Related U.S. Application Data

No. 13/685,006, filed on Nov. 26, 2012, which is a continuation of application No. 11/794,105, filed as application No. PCT/NZ2005/000345 on Dec. 23, 2005, now Pat. No. 8,328,043.

(51) Int. Cl.

| | |
|---|---|
| ***B65D 25/04*** | (2006.01) |
| ***B65D 1/32*** | (2006.01) |
| ***B65D 21/08*** | (2006.01) |
| ***B65D 35/22*** | (2006.01) |

(56) References Cited

U.S. PATENT DOCUMENTS

| | | | | |
|---|---|---|---|---|
| D96,782 | S | 9/1935 | Sloan | |
| 2,685,316 | A * | 8/1954 | Krasno | B65D 1/0292 206/524.8 |
| 3,054,679 | A * | 9/1962 | Bradford | B65D 77/2032 426/123 |
| D196,392 | S * | 9/1963 | Politis | D9/425 |
| 3,321,123 | A * | 5/1967 | Denzil | B29C 65/7441 229/123.2 |
| 3,456,850 | A | 7/1969 | Uhlmann | |
| D219,959 | S | 2/1971 | Anderson | |
| 4,040,561 | A * | 8/1977 | Philippon | B65B 7/168 229/102 |
| D251,586 | S | 4/1979 | Levenhagen | |
| D253,168 | S | 10/1979 | Nilsson et al. | |
| 4,442,969 | A | 4/1984 | Holden | |
| 4,473,165 | A | 9/1984 | Lentjes | |
| D276,025 | S | 10/1984 | Hexamer | |
| D280,489 | S | 9/1985 | Holden | |
| D283,789 | S | 5/1986 | Kodousek | |
| D288,295 | S | 2/1987 | Holden | |
| 4,792,086 | A * | 12/1988 | Chen | A45F 3/20 229/117 |
| 4,817,801 | A | 4/1989 | Schwaikert | |
| 4,875,620 | A * | 10/1989 | Lane, Sr. | B65D 1/26 229/404 |
| 5,054,631 | A * | 10/1991 | Robbins, III | A47G 21/18 215/229 |
| D326,412 | S | 5/1992 | Lesquir | |
| 5,174,458 | A * | 12/1992 | Segati | B65D 1/0292 215/383 |
| 5,213,253 | A | 5/1993 | Fantoni et al. | |
| D339,288 | S | 9/1993 | Segati | |
| D342,896 | S | 1/1994 | Gottofredi | |
| D346,741 | S | 5/1994 | McIntyre | |
| 5,316,184 | A | 5/1994 | During | |
| D353,997 | S | 1/1995 | Kashino et al. | |
| D361,511 | S | 8/1995 | Dickinson et al. | |
| 5,460,324 | A | 10/1995 | Vinther | |
| D370,345 | S | 6/1996 | Wolff | |
| D378,734 | S | 4/1997 | Hardy et al. | |
| D380,381 | S | 7/1997 | Krupa et al. | |
| D385,784 | S | 11/1997 | Krupa et al. | |
| 5,746,312 | A * | 5/1998 | Johnson | A47G 19/2227 206/19 |
| D409,485 | S | 5/1999 | Christy, Jr. | |
| 5,899,335 | A | 5/1999 | Boyer et al. | |
| 6,022,570 | A * | 2/2000 | Richmond | A45F 3/18 206/19 |
| 6,092,687 | A * | 7/2000 | Hupp | B65D 43/162 220/315 |
| 6,170,712 | B1 | 1/2001 | Kasboske | |
| D441,611 | S | 5/2001 | Hudson et al. | |
| 6,223,932 | B1 * | 5/2001 | Usui | B65D 1/0292 215/382 |
| 6,315,151 | B1 * | 11/2001 | Hupp | B65D 1/225 220/6 |
| 6,523,686 | B1 * | 2/2003 | Bae | B65D 1/30 206/315.9 |
| 6,581,811 | B1 * | 6/2003 | Schillaci | A45F 3/16 220/666 |
| 6,662,964 | B2 | 12/2003 | Higuchi | |
| 6,669,040 | B2 * | 12/2003 | Higuchi | B65D 1/0292 215/381 |
| D504,325 | S | 4/2005 | Vovan | |
| 7,108,151 | B2 * | 9/2006 | Higuchi | B65D 1/0292 215/381 |
| D548,069 | S | 8/2007 | Sagel et al. | |
| 7,549,551 | B2 | 6/2009 | Tyberghein | |
| 7,600,653 | B2 | 10/2009 | Kasboske | |
| 2001/0023870 | A1 * | 9/2001 | Mihalov | B29C 65/18 220/359.3 |
| 2003/0141218 | A1 * | 7/2003 | Stephens | B65D 1/30 206/484 |
| 2004/0040971 | A1 * | 3/2004 | Athalye | B65D 5/3628 220/666 |
| 2004/0164076 | A1 * | 8/2004 | Baker | B65D 1/30 220/23.4 |
| 2007/0017921 | A1 | 1/2007 | Carmona | |

FOREIGN PATENT DOCUMENTS

| | | |
|---|---|---|
| EP | 0215741 | 3/1987 |
| EP | 0880455 | 12/1998 |
| EP | 1323639 | 7/2003 |
| EP | 1502867 | 2/2005 |
| FR | 1356549 | 3/1964 |
| FR | 2652061 | 3/1991 |
| GB | 798338 | 7/1958 |
| JP | 06-047826 | 12/1994 |
| JP | 08/080945 | 3/1996 |
| JP | 10-86991 | 4/1998 |
| JP | 11-20817 | 1/1999 |
| JP | 10-334236 | 6/2000 |
| JP | 2000-159233 | 6/2000 |
| JP | 11-104034 | 10/2000 |
| JP | 11-294287 | 4/2001 |
| JP | 2001-114284 | 4/2011 |
| KR | 2006/137674 | 12/2006 |
| WO | 90/012741 | 11/1990 |
| WO | 93/16926 | 9/1993 |
| WO | 96/22919 | 8/1996 |
| WO | 96/27527 | 9/1996 |
| WO | 98/36978 | 8/1998 |
| WO | 00/03923 | 1/2000 |
| WO | 01/98153 | 12/2001 |
| WO | 06/117178 | 11/2006 |
| ZA | 893383 | 1/1990 |

* cited by examiner

CONTAINER WITH CONCERTINA SIDE WALLS AND BASE

FIELD OF THE INVENTION

The present invention relates to a container which may for example be used for the containment and convenient dispensing (preferably without utensils) therefrom of foods such as pet food, sauces, yoghurt, custard or the like or other liquid or semi fluid materials, e.g. oil or grease, glue, resins.

BACKGROUND

Consumer packaging is designed to take into consideration functionality and appearance. By way of example most single serve yogurt containers are made from a thermoformed plastic. A sheet of thermoplastic is drawn by a thermoforming machine into a container shape. This generally consists of either a round or square side wall configuration to define a containment region with an upper opening surrounded by a perimeter flange. The flange provides a place for a foil seal to engage with the thermoformed plastic to create an openable closure to the containment region. Some of such containers provide their opposed side wall(s) substantially parallel to each other although a slight taper may be provided to allow for the thermoformed product to be extracted from the thermoforming machine. However where the side walls of such a container are parallel, an empty container (for example to be shipped from its place of manufacture to its place of packaging), will not be able to nest with like containers to reduce the total space required for the transport of such containers in their empty state.

One serve yogurt containers may also need to be stacked, one on top of each other, after they have been filled and sealed. There is a limit to the height that a stack of such containers can reach in light of the strength of the side walls of each of the containers. The containers will need to have sufficient wall thickness to allow for a stack of a suitable or desired height to be achieved without problems with buckling of the side walls and a collapsing of such containers under the weight of the stack above. Increasing the wall thickness will increase the material costs of each container manufactured. It would be desirable for such a wall thickness to be able to be reduced so as to reduce the cost of goods manufactured yet still provide a container that is of a comparable strength to a container with plain side walls.

Consumption of the food contained within a one serve sized container is often achieved by the use of a spoon. The spoon may transfer the food content directly to the mouth of a consumer. A spoon is a further element that needs to be provided to allow for the contents of such a container to be consumed. Yogurt and custard or other food consumer products such as those having a jelly like consistency are not to any significant extent able to be poured or dispensed quickly from a container due to their high viscosity and/or gelatinous nature. It is therefore necessary to use a spoon to transfer some if not a substantial part of the contents from a container. There also seems to be a trend with consumer packaging products for food containers to allow the food contents to be dispensed without the need for any further implements or utensils. Whilst some non viscous fluids or non gelatinous fluids product contained within a container can be poured from such a container, yogurt or other similar food products can have poor pour characteristics. Such fluids may be Newtonian or non Newtonian fluids that may not necessarily, purely by its viscosity characteristics, have such poor pour characteristics. It is for this reason that normally a spoon is used to dispense the contents of the product from a container. The capability of a package to self dispense a significant part of the contents is being addressed by consumer packaging designers and manufacturers.

Recycling of containers containing consumables is also an important consideration in packaging design. The plain rectangular form of yogurt containers, do not conveniently lend themselves to being compacted. To facilitate efficiencies in recycling, compacting of consumable packaging is a distinct advantage.

It is therefore an object of the present invention to provide a container which will address any one or more of the abovementioned desiderata or the abovementioned disadvantages and/or which will at least provide the public with a useful choice.

BRIEF DESCRIPTION OF THE INVENTION in first aspect the present invention consists in a container including at least one side wall region and a basal wall region surrounding a containment region having an upper opening surrounded by a flange at the ends of the side wall(s) distal from said basal wall region, said side wall(s) include a region of concertina whereby, upon the squeezing of the side wall(s), said basal wall region of the container is compacted more, relative to the extent of the upper opening.

Preferably said side wall(s) are concertinaed in diametrically opposed regions of said side wall(s).

Preferably the region of concertina of said side wall(s) extend between the basal wall region and said flange.

Preferably said region of concertina extend from said basal wall region upwards towards said flange.

Preferably said basal wall region includes a region of concertina.

Preferably the region of concertina of said basal wall, extend in a direction parallel to a plane parallel to which the side wall(s) concertina features extend.

Preferably said container is of a quadrilateral plan shape and includes four side walls extending between said flange and said basal region.

Preferably said four side walls include a first pair of opposed side walls by which the region of concertina of said side walls are defined.

Preferably said region of concertina of said side wall(s) include at least one trough formed in said side wall(s) and that extends between said flange and said basal wall region.

Preferably said region of concertina of said side wall(s) include at least two troughs and a ridge intermediate of two troughs, formed in said side wall(s) and that extends between said flange and said basal wall region.

Preferably said region of concertina of said side wall(s) include a series of ridges and troughs extending between said flange and said basal wall region.

Preferably (each) said trough extends from said basal wall region towards said flange but is/are terminated by a web that transitions the side wall between said trough and said flange.

Preferably each said web is a planar triangular web with one of its base sides parallel to said flange and one of its apex in the trough.

Preferably each said web is a planar triangular web with one of its base sides parallel to and contiguous said flange and one of its apex in the trough.

Preferably said trough is one defined by said side wall(s) to extend towards said containment region.

Preferably a partition wall is included in the containment region to define two partition wall separated compartments said partition wall extending perpendicular to the direction of squeezing.

Preferably said flange includes a zone of weakness to allow for a fracturing of the flange.

Preferably said flange includes a zone of weakness to allow for a fracturing of the flange and wherein said zone of weakness is located intermediate the non-concertina opposed side walls.

Preferably said opposed side walls that include said concertina, at a given height above the basal wall region, vary in distance from each other by virtue of the concertina.

Preferably the variation of distance is symmetrical about a vertical mid-plane intermediate of said opposed side walls that include said concertina.

Preferably said container is a food container.

Preferably said concertina of said side walls meet at said basal wall region.

Preferably said side walls are curved towards each other from said opening and meet at said basal wall region.

Preferably said other pair of side walls are planar side-walls.

Preferably said container is an open top container.

Preferably said opening is the same or larger in size than said basal wall region.

Preferably said flange extends in a plane parallel to the direction of squeezing.

Preferably said flange projects outwardly from said opening and beyond the side wall(s)

In a further aspect the present invention consists in a container as herein described and as shown in the accompanying representations.

In a further aspect the present invention consists in a container as shown in the accompanying representations.

In a further aspect the present invention consists in a collapsible container comprising;

a containment region defined by two opposed side walls extending between a flange surrounding opening and a base region and between two other opposed side walls that extends between said two opposed side walls and between said base region and said flange, said two side walls being of a shape to facilitate their concertinaing in a direction bringing the two other opposed side walls together at least at the base region.

Preferably said flange is a planar flange extending about said opening.

Preferably said two side walls, at any given plane parallel to said flange, are not constant in distance from each other save for at a region at or proximate said flange.

Preferably said two side walls, at any given plane parallel to said flange, are not constant in distance from each other save for at a region at or proximate said flange, the distance being proximate most at at least one point of each opposed side wall, said at least one point being intermediate of said other two opposed side walls.

Preferably said at least one point is midway between said two opposed side walls.

Preferably said distance proximate most is defined at at least two points of each opposed side wall.

Preferably said base region is defined by a quadrilateral shaped base wall.

In a further aspect the present invention consists in an open top container defining an opening surrounded by a flange at the top of its wall(s) and including concertinaing features in at least some of its wall(s), the indent of said concertinaing feature(s) transitioning to the flange with a region adapted to encourage compaction of the basal region of said container relative to compaction of the flange.

In a further aspect the present invention consists in a reservoir including a mouth and at least one concertina feature functionally non intrusive of the perimeter of the mouth whereby, by squeezing, the volume of the reservoir can be reduced without any corresponding concertinaing of the mouth of the perimeter.

Preferably a rim surrounding said mouth perimeter for foil sealing said mouth perimeter.

Preferably the mouth perimeter is rendered less planar in its disposition upon the squeezing.

Preferably that is freestanding and has an open top as said mouth.

In a further aspect the present invention consists in a container including at least one side wall and a basal wall surrounding a containment region that includes an upper opening at the top of the side wall(s), said side wall(s) including concertina side wall features save for at or towards the top of said side wall(s), whereby upon the squeezing of the side walls, at least said basal wall of the container is compacted more relative to the extent of the upper opening.

In a further aspect the present invention consists in a collapsible container comprising;

a containment region defined by at least two opposed side walls extending between a flange surrounding opening and a base region and between at least one other wall that extends between a opposed side walls and from said flange and that defines a base, said wall being of a shape to facilitate its concertinaing in a direction bringing the two opposed side walls together at least at the base region.

In a further aspect the present invention consists in a dispensing container comprising or including a mouthed reservoir containing or to contain material able to be expressed, wherein the reservoir has at least one concertina feature functionally non intrusive of the mouth perimeter whereby, by squeezing, the volume of the reservoir can be reduced without any corresponding concertinaing of the mouth of the perimeter thereby to at least in pat express any content material via the mouth.

In a further aspect the present invention consists in a four sided container comprising a first pair of opposed side wall, a second pair of opposed side wall extending between said first pair of opposed side walls, a base wall extending between said first pair of opposed side walls and said second pair of opposed side walls, said first pair of opposed side walls and said second pair of opposed side wall and said base wall defining a containment region to contain material and having an open or openable top mouth opening via which said material can be dispensed from said containment region, wherein the length (measured in a direction parallel to the base wall) of said first pair of opposed side walls in greater than the distance between the second pair of opposed side walls by virtue of at least one elongate trough formed in each said first pair of opposed side walls and extending into or towards said containment region and having an elongate direction extending in a direction between said mouth and base to provide a predisposition to a collapsing of said first pair of opposed side walls under the action of a squeezing force applied to said second pair of side walls and wherein said opening includes a perimeter of a configuration resistant to compression in the squeezing direction to prevent the same extent of collapsing of said mouth as at least the lower regions of said first pair of side walls to thereby dispense material via an open said mouth.

Preferably said opening is of a quadrilateral perimeter shape.

Preferably said opening is surrounded by a flange that extends outwardly from said containment region.

Preferably said flange is a planar flange that is perpendicular the planes of said first and second opposed side walls.

Preferably said mouth is of a perimeter shape the same as the base wall plan shape.

Preferably the distance between the ridges and troughs of on of said side walls is no greater than ⅓ the distance between opposed sidewalk.

Preferably the distance between the ridges and troughs of on of said side walls is greater than 1/20 the distance between opposed sidewalls.

Preferably the distance between the ridges and troughs of on of said side walls is greater than 1/10 the distance between opposed sidewalls.

Preferably there are at least two troughs per concertina feature.

Preferably there are three troughs per concertina feature.

Preferably there are four troughs per concertina feature.

Preferably there are five troughs per concertina feature.

Preferably there are six troughs per concertina feature.

Preferably a concertina feature is identical to the opposed concertina feature.

Preferably wherein said peaks of said concertina features extend to the underside of the flange.

Preferably said partition wall extends from the basal region to said flange.

Preferably said partition wall extends between said basal region and said flange.

Preferably said food is one selected from yogurt, custard, ice cream and jelly.

Preferably said container is a food container to include a liquid beverage.

Preferably said container is a non-food containing container.

This invention may also be said broadly to consist in the parts, elements and features referred to or indicated in the specification of the application, individually or collectively, and any or all combinations of any two or more of said parts, elements or features, and where specific integers are mentioned herein which have known equivalents in the art to which this invention relates, such known equivalents are deemed to be incorporated herein as if individually set forth.

DETAILED DESCRIPTION OF THE INVENTION

Figure 1:
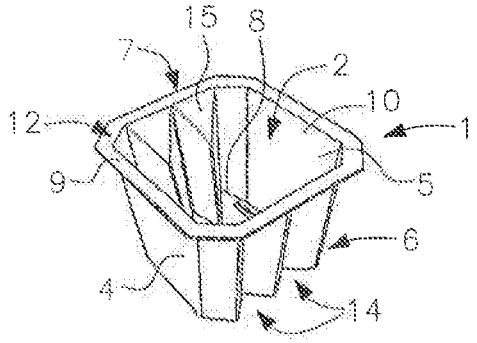
FIG. 1 is a perspective view of one example of a preferred form of a container.

With reference to FIG. 1 there is shown a moulded container 1. The moulded container 1 is preferably made from a thermoformed or formable material and in its precursor form comes in a sheet of such a material. A deep drawing thermoforming machine may subject the precursor sheet of material to heat and pressure and with the provision of suitable moulding surfaces can form the containers as herein described. It may also be made by injection moulding or vacuum forming or other suitable processes. Whilst in its most preferred form the container has a containment region of a volume between 100 and 250 ml it will be appreciated by a person skilled in the art that the container can be upsized and downsized yet still achieve the same functionality and desired characteristics as will herein be described.

The moulded container 1 consists of a side wall or walls and a base wall or region. In the example shown in FIG. 1, the moulded container 1 is substantially a four sided container having a first pair of opposed side walls 4, 5 and a second pair of opposed side walls 6, 7. It is at least the second pair of opposed side walls 6, 7 that each incorporate a profile predisposed to forming a concertina profile. The profile may also be considered a bellow like profile. Profiles predisposed to forming a concertina profile will hereinafter be described in more detail but may include a concertina profile. The "V" shaped concertina profile is the most preferred form.

Intermediate and at the bottom of the opposed pair of side walls 4, 5 and 6, 7 is a base 8.

The base is provided below the side walls 4, 5 and 6, 7 and in conjunction with the side walls defines the containment region 2. At the upper end of the side walls 4, 5 and 6, 7 may be a perimeter flange 9. The perimeter flange need however not be present.

This perimeter flange 9 is preferably provided about the mouth opening 10 of the moulded container 1. The perimeter flange 9 flares outwardly from the containment region 2 and from the side walls 4, 5 and 6, 7 to present a surface 12 with which a lidding 11 can engage. The perimeter flange 9 may present a substantially continuous and planar engagement surface 12 onto which the lidding 11 can engage. The lidding may for example be a foil material and may be affixed by commonly known techniques that may allow for the lidding 11 to be peeled from the perimeter flange 9. Such peeling is in part demonstrated with reference to FIG. 9. An alternative form of the lidding 11 is shown in FIG. 10. The lidding may be of a kind (or its affixing to the perimeter flange 9 may be of a kind) that creates a permanent bond to the perimeter flange 9. In the example of FIG. 10, the mouth opening 10 of the moulded container 1 is in part exposable by a spout and cap arrangement 13. A cap 13 can for example be threadingly engaged to a spout to allow for the opening of the container and re-closing when desired.

Figure 8:
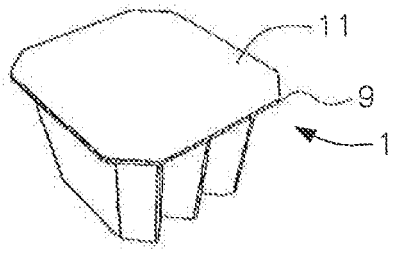
FIG. 8 is a perspective view of the container of FIG. 1 with foil lidding engaged to the perimeter flange.
Figure 9:
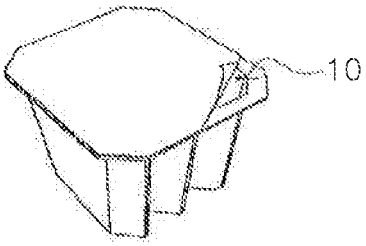
FIG. 9 is a perspective view of FIG. 8 but where the foil lidding has in part been peeled away from the perimeter flange.
Figure 10:
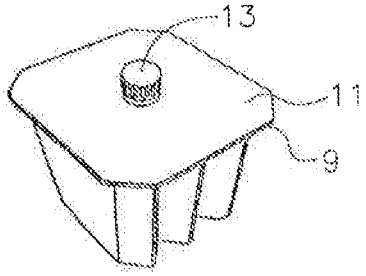
FIG. 10 shows an alternative arrangement of lidding where the lidding may be applied to the flange in a more permanent and non-peelable manner but where an outlet spout is incorporated with the lidding.

In the peelable foil arrangement shown in FIGS. 8 and 9 the peelable foil may be of a kind that can be used to re-seal the container. Re-sealable closures are known that could be utilised for the present invention.

The opposing pair of side walls 6 and 7 include surface features that are preferably of a concertina like profile. The surface features ensure that the side walls have a predisposition to forming a concertina like profile. The concertina like profile is a profile that will allow for a compression of the other side walls 4 and 5, towards each other.

Figure 27:
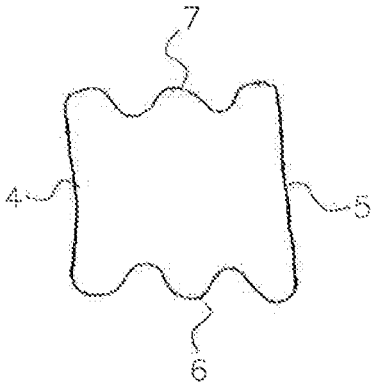
FIG. 27 is a plan view of an alternative form of a container shown through section AA of FIG. 28.
Figure 28:
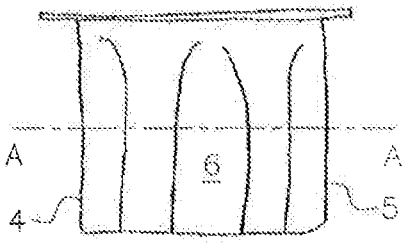
FIG. 28 is a side view of the container shown in sectional view of FIG. 27.
Figure 29:
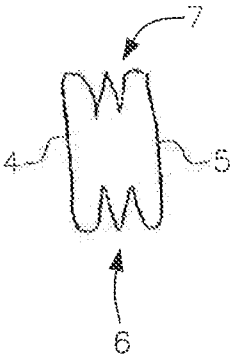
FIG. 29 is a view of the container of FIG. 27 in a compressed condition.

The V shaped profile is the most preferred form of profile. Alternatively the profile may be arcuate as shown in FIGS. 27 and 28.

The preferred concertina profile may also be defined as indents provided in an otherwise planar side wall of the opposing side wall 6 and 7.

Figure 30:
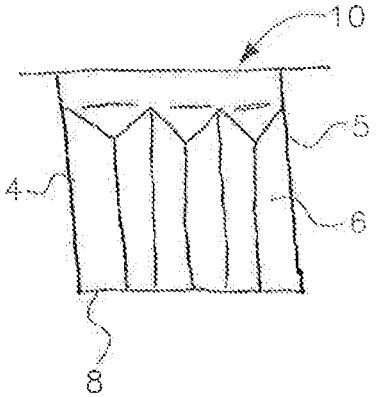
FIG. 30 illustrates a variation to the container of the present invention wherein the concertina side wall relief does not extend to the rim of the opening and/or perimeter flange.

These indents or concertina features extend vertically and preferably near or from the lower end of the side walls at or adjacent the base 8, to or towards the upper end of the side walls at or towards the mouth 10. With reference to FIG. 30 however it can be seen that the indents of the side walls 6, 7 need not extend completely from the base 8 to the mouth opening 10 of the container. In the example shown in FIG. 30, the indents extend from the base 8 towards the mouth opening 10 but terminate short of the mouth opening 10. In this condition compression of the side walls 5, 4 towards each other can still occur and is facilitated at regions where the indents are provided in the side walls 6, 7.

The container shown in FIG. 1 provides the opposing side walls 6 and 7 with two indents 14 in each sidewall. In an alternative example as for example shown in FIG. 5, the opposing side walls 6 and 7 include four indents each.

For the preferred "V" shaped indents, over a given distance between the side walls 4 and 5, and for any given depth of indent an increasing number of indents 14 in the side walls 6 and 7 will result in the angle between the trough of the indent and the peak of the indent (angle A) increasing towards 90 degrees. The closer the angle is to 90 degrees the easier it will be for the container to be squeezed. The action of squeezing will hereinafter be described in more detail.

Figure 17:
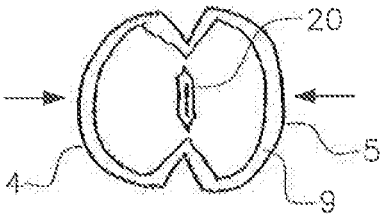
FIG. 17 is a plan view of an alternative shape of a container wherein there are two cells or compartments.

Whilst there is described a container which is generally of a square or rectangular plan shape, it is envisaged that the present invention can provide a container in a more circular or oval shape yet still incorporate opposed side walls 6 and 7 which incorporate the concertina relief features. Diametrically opposed regions of such a circular container may incorporate concertina features for the purposes of allowing the container to be squeezed in a manner as hereinafter described. FIG. 17 shows an example.

Figure 7:
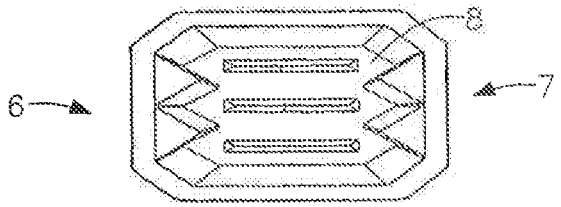
FIG. 7 is a plan view of yet an alternative configuration of a container.

With reference to FIG. 7 there is shown yet a further variation where the container is substantially of a rectangular plan view. In the example shown in FIG. 7 it is the minor side walls 6, 7 that incorporate the concertina features. Alternatively it could be the major side walls of such a rectangular shaped container that could incorporate the concertina relief features.

In the most preferred form the side walls 4 and 5 are of a planar shape. Such side walls preferably do not include any concertina relief features and may for example be of a flat or slightly curved surface.

Figure 32:
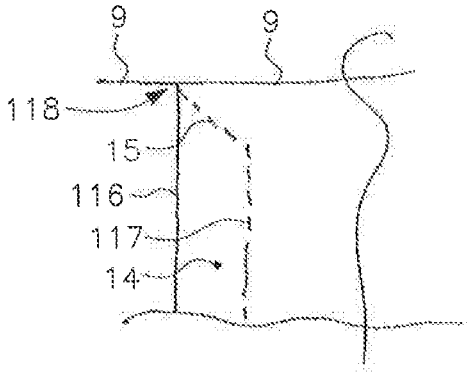
FIG. 32 is a side view of the upper portion of a container as for example shown in FIG. 5, and viewed from direction C.

At or towards the upper end of the indents 14 a transition web 15 may be provided. It transitions the side walls from the indents, (being in plan view, angled to the straight edge of the flange 9) to being straight. In the examples shown where the indents are V shaped, the transition web extends substantially diagonal (when viewed in side view) to the longitudinal direction of the indents 14. With reference to FIG. 32 it can be seen that the web 15 (shown in phantom) extends diagonally to the longitudinal direction of the peak 116 and trough 117 of the indent 14 of the side wall.

Figure 5:
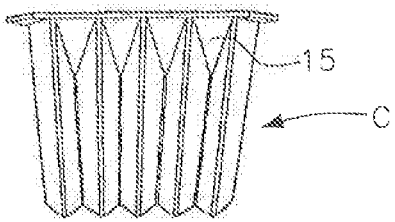
FIG. 5 is a side view of another example of a container.
Figure 6:
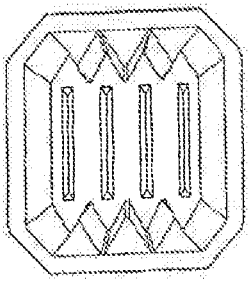
FIG. 6 is a bottom view of yet another container.

With reference to the containers of the kind as for example depicted in FIG. 5 where the indents are V shaped, the transition web or webs 15 are of a triangular shape. It will be appreciated that (and with reference to FIGS. 27 and 28, where the indents are of a different cross sectional profile) the transition webs need not be of a triangular shape.

The webs 15 assist in creating a transition between the indents 14 and the perimeter flange 9 or the straight upper edge of side walls 6, 7. The transitioning from a concertina side wall profile (or profile that is predisposed to forming a concertina profile) to a straight upper edge, assists in providing the desired effect in the movement of the features of the container during compacting. It may be the straight and preferably substantially continuous upper edge at region 118 (as shown in FIG. 32) of the transition webs 115, the transition webs themselves and/or the perimeter flange 9, that each extend substantially parallel to the direction of compression, that assist in ensuring that the mouth of the container does not compact like the base of the container.

Figure 31:
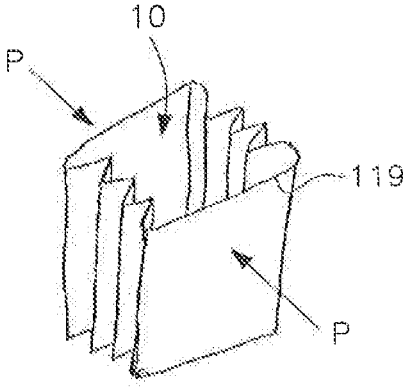
FIG. 31 is an example of a container not part of the present invention shown, for the purposes of illustrating the undesired configuration where compacting of the mouth opening can occur.

One or more of such aspects assist in ensuring that the mouth does not compact like the base of the container compacts. Instead they encourage the flange 9 to arc about the containment region 2, as for example shown in FIGS. 11, 12 and 13. With reference to FIG. 31, where the container as shown, does not include any structural member extending continuously in the compression direction PP at the mouth opening, the mouth opening 10 will compact. The perimeter 119 (whether flanged or not) in this example will intrude the mouth opening 10.

The web or webs 15 (in the preferred form where they are triangular in shape) are planar in form. Their plane is preferably parallel to the direction in which the compacting force PP is applied. As a result these webs present resistance to this region being compacted. In particular at the upper edges 118 of the webs 15, where the webs may substantially abut each other, a straight edge is formed parallel to direction PP.

The container of the present invention may or may not be provided with the upper flange 19. Even without the upper flange 19, sufficient resistance to compacting at the mouth, to achieve the desired form of the container in its compacted state, can be achieved by the containers as herein described.

When provided, the upper flange 9 does assist in providing additional resistance to compacting at the mouth opening as well as providing a surface for a lid to seal with. Alternatives to the flange 9 may be provided depending on the nature of the closure or lidding that is desired for the container.

Figure 13:
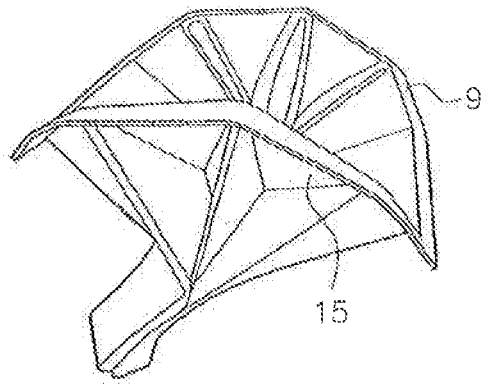
FIG. 13 is a view in an alternative direction and prior to a full compression of the side walls to squeeze the contents of the container through the mouth opening for subsequent consumption.
Figure 33:
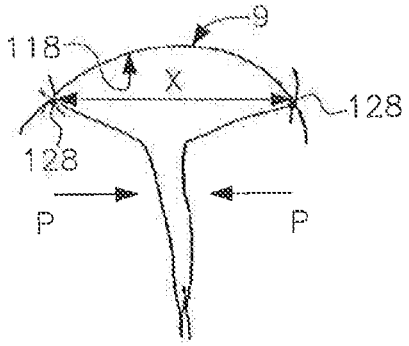
FIG. 33 is a side view of a container illustrating features in respect of the container in its compacted form.

In a preferred form, the webs 15 help create an arc or arcuate like form of the perimeter flange 9 during compacting of the base. As can be seen in FIG. 13 the perimeter flange 9 is curved when the base and side walls 6, 7 are compacted. As can be seen with reference to FIG. 33, compacting of the containment region by the application of the pressure in direction PP does subject the perimeter flange 9 to a compression force in the same directions. As the material of the present invention has flexibility, there is a natural tendency for the edges 128 to move closer together. As a result of the straight line resistance offered by the perimeter flange 9 and/or the edges 118 and/or webs, the previously straight edges 118 can move closer together but only as a result of the bending of the edge 118 to an arcuate form as shown in FIG. 33. Distance X is less in the compacted form than in the uncompacted form. This assists in exposing the upper zone of containment region 2 of the container to allow for a person to achieve more convenient access by their mouth and/or tongue or spoon or scoop for the purposes of removing and consuming the contents.

For edible contents, when the perimeter flange 9 is in such an arcuate form, it is more convenient for a person's mouth or tongue to engage with lower portions of the containment region without the person's nose impinging or hitting the perimeter flange. Part of the perimeter (and where provided, the perimeter flange) has been folded down thereby reducing the possibility of a person's nose from touching the perimeter (and flange) and thereby allowing for a person to gain access to previously deeper parts of the containment region. Furthermore The webs 15 eliminate any significant pockets in the compacted form of the container at and below the perimeter flange 9.

Figure 11:
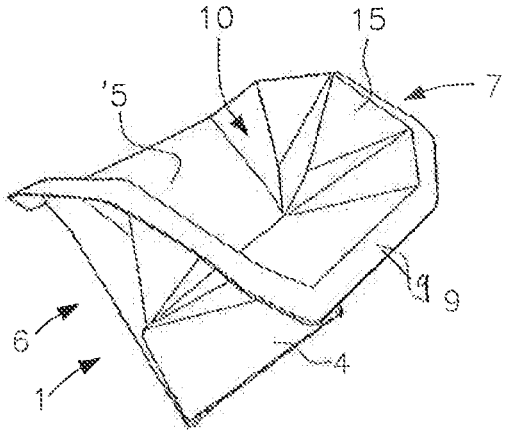
FIG. 11 is a perspective view of the container of FIG. 1 having been squeezed to displace food contents from the containment region of the container.
Figure 12:
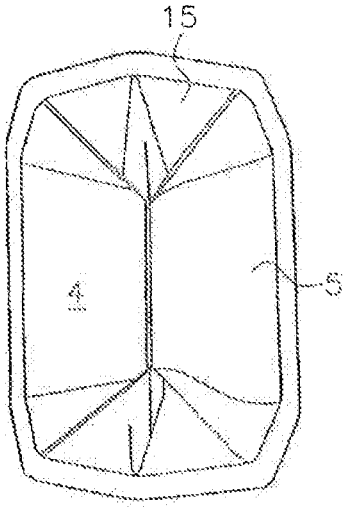
FIG. 12 is a plan view of FIG. 11.

As well as forming of the perimeter into an arcuate form, exposure of the upper regions of the side walls 4 and 5, to what can be seen in FIG. 11 as being substantially V shaped from, occurs. This also aids in allowing for convenient access to be obtained to the contents of the container. This shallow V shaped form of the upper portions of the side walls 4 and 5 allows a person to conveniently transfer the contents of the container that is displaced within the shallow V shaped formed side wall regions.

Figure 14:
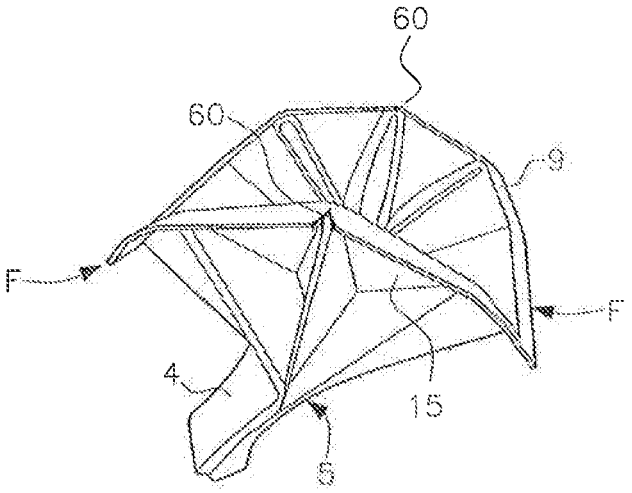
FIG. 14 is a perspective view showing a container in full compression wherein the container also includes a line or zone of weakness through the perimeter flange 9 to assist in further collapsing of the perimeter flange 9.
Figure 15:
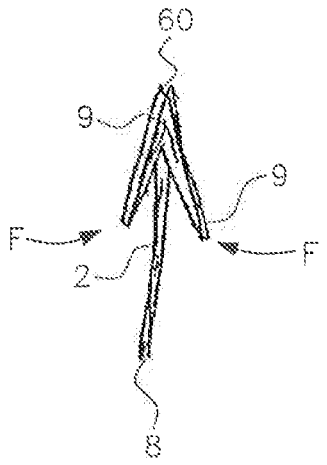
FIG. 15 is a side view of the container of FIG. 14 but in a fully compressed and collapsed condition

With reference to FIGS. 14 and 15, a line or zone of weakness 60 may be provided at the perimeter flange 9. The zone or line of weakness 60 is preferably provided substantially midway between the opposing side walls 4 and 5. The zone or line of weakness allows for a fracturing of the perimeter flange 9 to occur at a certain stage during either the compression of the base or during compacting of the base or during additional compression of the perimeter flange by a squeezing in for example the opposing directions FP on the perimeter flange at its regions near the side walls 4 and 5. A fracturing of the perimeter flange 9 at the zone or line of weakness 60 will result in the perimeter flange 9 from significantly reducing its structural rigidity to allow for it to be compressed. Such compression is shown for example with reference to FIG. 15 to bring the regions of the perimeter flange 9 proximate the side walls 4 and 5, closer together. This allows for the container to be manipulated to encourage a condition that is significantly more compressed than in its completely non-compressed and non-compacted state. Such compression has the benefit of reducing the volume of the container thereby adding to the efficiencies in any recycling of the container. A compressed container for example being delivered to a recycling plant, will place significantly lower volume demands on its transportation.

The provision of the concertina opposing side walls 6 and 7 may also enhance the side wall strength of the container 1. As a result of the concertina configuration the side wall strength is enhanced to resist any buckling of the walls under a pressure pressing onto the container in a top to bottom direction. The concertina increases the total effective side wall length as well as being of a shape which provides greater resistance to buckling than a planar side wall. Such increase in strength can allow for a reduction in the side wall thickness to occur. A reduction in thickness can lead to a reduced cost of manufacture.

Figure 2:
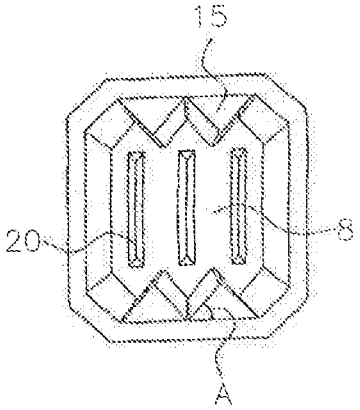
FIG. 2 is a plan view of FIG. 1 looking down through the mouth opening of the container of FIG. 1.
Figure 3:
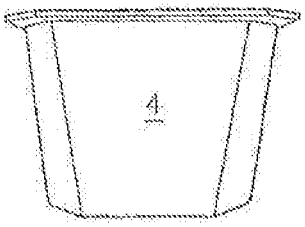
FIG. 3 is a side view of the container of FIG. 1.
Figure 4:
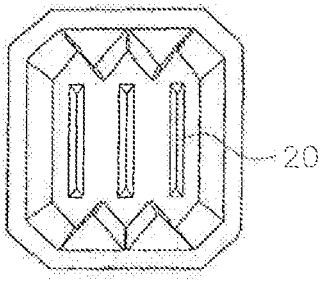
FIG. 4 is a bottom view of the container of FIG. 1.

The concertina features are also provided to assist in a squeezing of the container. In conjunction with the concertina side walls where such are provided for the purposes of a squeezing of the container, the base 8 is preferably also provided with surface relief 20 that can facilitate in the compacting of the base 8 when the container is being squeezed. Such surface relief can be corrugations or concertina like features that have a longitudinal characteristic. Longitudinal directions of the surface relief 20 preferably extends in a direction parallel to the general plane of the first opposed pair of side walls 4, 5. The surface relief 20 preferably extends substantially all the way between the second pair of opposed side walls 6, 7. As can be seen in FIG. 2 three such surface relief features 20 are provided.

The number of such surface relief features 20 need not (but preferably do) correspond to the number of indents 14 provided to the second pair of opposed side walls 6 and 7. A sufficient number of such surface relief features are provided to assist in the compacting of the base 8 upon the squeezing of the container.

In the most preferred form when looking at the base from below, the surface relief 20 are recesses extending into the containment region. The relief 20 thereby preferably does not project downwardly beyond the otherwise generally planar base 8.

They could be relief extending (when compacted an/or pre-compacting) away from the container.

As mentioned it is desirable to allow for the contents contained within the container to be dispensed without the need for additional utensils or implements. The present invention allows for this to be achieved by the fact that the side walls 6, 7 allow for the bringing together of the side walls 4 and 5. The force applied to the side walls 4 and 5, such as by a thumb and forefinger, will displace the opposing side walls 4 and 5 together. The concertina relief features will each condense towards each other and the indents will decrease in size upon the squeezing of the opposing side walls 4 and 5 together. The base will also compact.

The volume reducing effect of the squeezing of the container will in a first instance displace the contents out through the opening 10 for a person to use their mouth directly, to consume the contents. Any content remaining within the then partially reduced volume of the containment region 10 can then be conveniently reached by for example a tongue or mouth of a person to transfer the remaining food contents from the containment region 10. This allows for convenient access and substantially full consumption of the contents of the container to be achieved by a person.

With the preferred tapered form of the container as shown in the accompanying drawings, the nesting of such a container with like containers can also occur. This will aid in the transport of the yet to be filled containers from its place of manufacture to a place where it may be filled.

Figure 16:
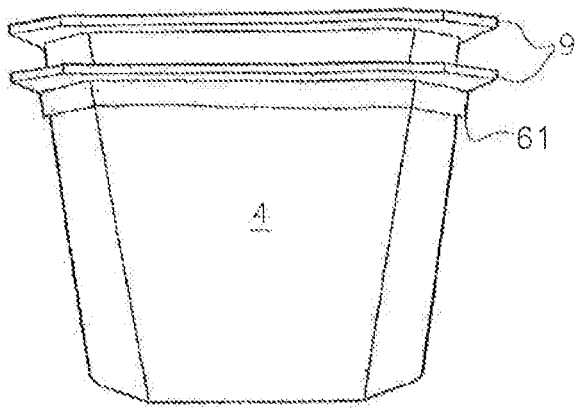
FIG. 16 is a perspective view of two containers stacked on top of each other showing a stacking lip or ridge incorporated in the containers to ensure that the perimeter flanges in a stacked condition do not contact each other which may be desirable where the containers are provided in a stacked form to allow for a filling and sealing machine to grip a top most or bottom most container of the stack for removal from the stack for subsequent filling and sealing.

FIG. 16 is a perspective view of two containers of the present invention stacked on top of each other showing a stacking lip or ridge 61 incorporated in the containers to ensure that the perimeter flanges 9 in a stacked condition do not contact each other. This is a feature that may be desirable where the containers are provided in a stacked form to a customer of an organisation manufacturing the containers to allow for the machines to grip a top most or bottom most container of the stack for removal from the stack for subsequent filling and sealing.

With reference to FIG. 17 there is shown a plan view of an alternative form of a container wherein arcuate side walls 4, 5 are provided and the bellowed or concertina side walls include only one recess. This form of the product can be manufactured according to the present invention to perform in a like manner to the form of the product shown in the other figures.

Figure 18:
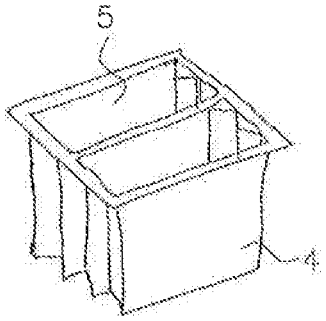
FIG. 18 is a perspective view of an alternative form of the present invention wherein a partition wall (that may be permanently formed with the container or removable therefrom) is provided intermediate of the opposed surfaces 4 and 5 extending between the concertina or bellowed sides to create two compartments within the containment region.
Figure 19:
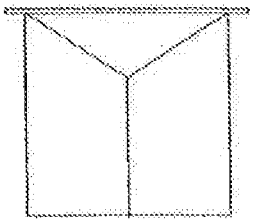
FIG. 19 is a side view of a two cell container wherein one side wall recess is provided in each side wall.
Figure 20:
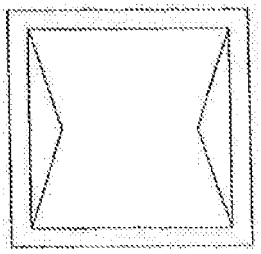
FIG. 20 is a plan or bottom view of a container of FIG. 19.
Figure 21:
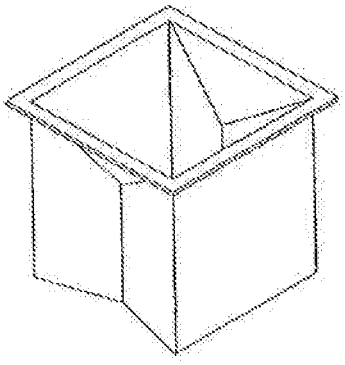
FIG. 21 is a perspective view of a container of FIG. 19.
Figure 22:
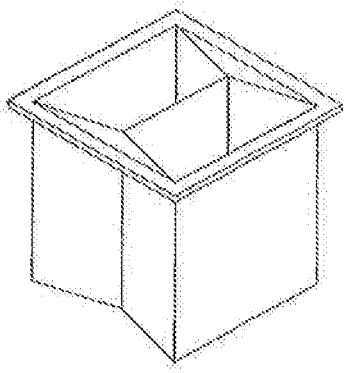
FIG. 22 is a perspective view of the container of FIG. 19 but with the addition of a partition wall which extends from the base upwardly to provide two compartments within the containment region of the container.
Figure 23:
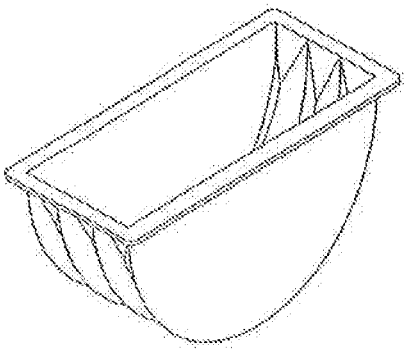
FIG. 23 is a perspective view of a curved profile container wherein the concertina side walls are curved and joined at the base of the container.
Figure 24:
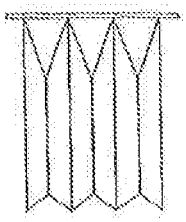
FIG. 24 is an end view of the container of FIG. 23.
Figure 25:
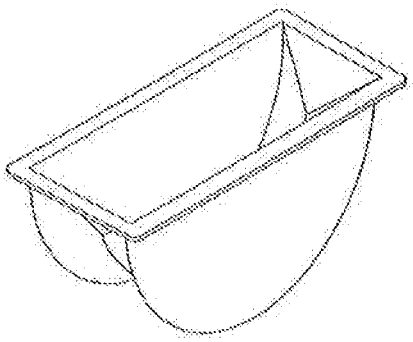
FIG. 25 is a multi cell configuration of the container of FIG. 23.
Figure 26:
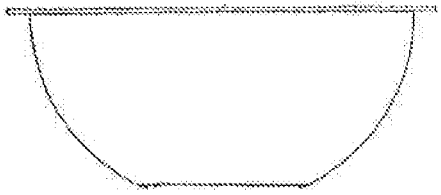
FIG. 26 is a side view of the container of FIG. 23 but wherein a flat base has been provided to allow for the container to be stably supported on a flat surface.

With reference to FIG. 18 is a perspective view of an alternative form of the present invention wherein a fixed or removable partition wall is provided intermediate of the opposed surfaces 4 and 5 extending between the bellowed sides to create two compartments within the containment region of the container of the present invention.

Figure 34:
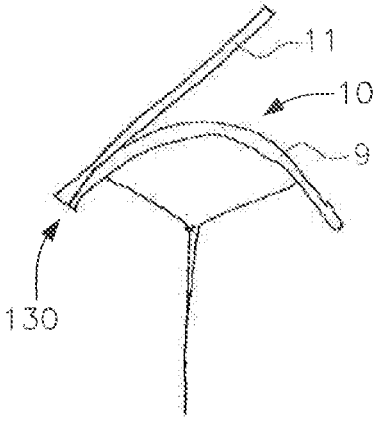
FIG. 34 illustrates a side view of a container in a compacted form with an example of a lidding system.

With reference to FIG. 34 there is shown a side view of a container in its compacted state wherein a lid 11 has popped open from the perimeter flange 9 to expose the mouth opening 10 of the container. In this example the lid 11 has popped or been peeled partially from the perimeter flange 9 yet remains attached at region 130. Where a lid, which is for example more of a substantially rigid material, is provided the tendency for the lid to lift from the flange 9 when the flange 9 is bent to an arcuate form will be encouraged. If the container is moved back to its pre-compacted state, the flange 9 will straighten and the lid will then again be substantially contiguous the flange 9.

Figure 35:
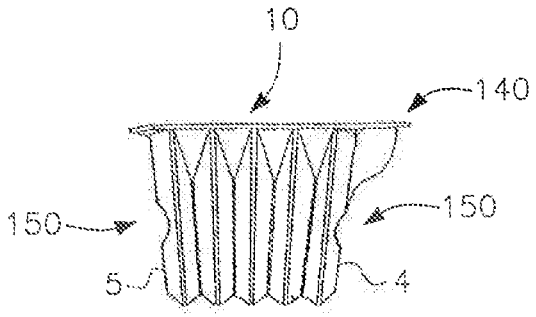
FIG. 35 is a side view of the container with a spouted opening provided.
Figure 36:
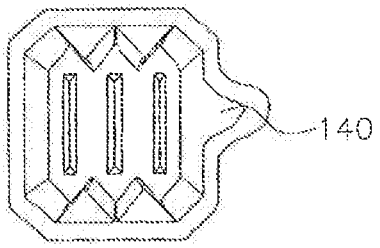
FIG. 36 is a plan view of FIG. 35.

With reference to FIGS. 35 and 36, there is shown a container of the present invention wherein a spout 140 is shown. The spout 140 is a deformation in a side wall 4 or 5 and is preferably lidded as part of the same lid that covers the general mouth opening 10. A partial pealing of the lid can expose the spout opening and a subsequent compression of the container can allow for part of its contents to be dispensed through the spout 140. The spout is a protrusion from the side wall 4 of the container. For the purposes of mass production a corresponding recess may be provided in the side wall 5 so that an end to end array of containers can be provided the spout of one container sitting within the recess of an adjacent container.

Also with reference to FIG. 35, there is shown in the side walls 4, 5 a surface indent that may be provided to encourage the use of the container during compression in the appropriate manner. The indent will encourage a persons fingers to engage at such an indent for the application of the force to compact the container. The indent 150 on one or each of the side walls 4, 5 may alternatively be ribs or other surface relief.

Alternatively the graphics on the side walls 4, 5 may be provided to encourage the appropriate use of the container.

The preferred wall thickness of the container (although such may vary from place to place) is in the range of 0.3 mm to 2.2 min-preferably 0.7 mm. The materials that may be used for the container may be P.S. or PET or PE. It may also be formed out of a metal, cellulosic material, waxed card etc.

The invention claimed is:

1. A container having an upper portion and a lower portion comprising:

a containment region including at least one side wall defining a pair of opposed side wall regions extending between the upper portion and the lower portion, and a basal wall at the lower region of the container;

an upper opening at least partially surrounded by a flange disposed at the upper portion at an end of said at least one side wall distal from said basal wall; and a plurality of pre-formed compaction enabling features at each of said at least one side wall and said basal wall reducing resistance to compression of said lower portion compared to said upper portion, readily enabling compaction of said lower portion compared to said upper portion such that, upon compression, said compaction enabling features are configured to substantially completely compact said basal wall to bring at least a lower region of said opposed side wall regions substantially adjacent to one another upon squeezing of said opposed side wall regions;

said compaction enabling features including at least one surface relief on said basal wall and a region of concertina in said side wall;

said region of concertina extending from said basal wall upwards towards said flange.

2. The container as claimed in claim 1, wherein said at least one side wall is concertinaed in opposed regions of said at least one side wall.

3. The container as claimed in claim 1, wherein the region of concertina of said at least one side wall extends in a direction between the basal wall and said flange.

4. The container as claimed in claim 1, wherein said at least one surface relief includes a region of concertina.

5. The container as claimed in claim 1, wherein the region of concertina of said basal wall extends in a direction parallel to a plane parallel to which the at least one side wall concertina features extend.

6. The container as claimed in claim 1, wherein said container is of a quadrilateral plan shape and includes four side walls extending between said flange and said basal wall.

7. The container as claimed in claim 6, wherein said four side walls include a first pair of opposed side walls in which the region of concertina of said side walls are defined.

8. The container as claimed in claim 1, wherein said region of concertina of said at least one side wall includes at least one trough formed in said at least one side wall and said at least one trough extends in a direction between said flange and said basal wall.

9. The container as claimed in claim 1, wherein said region of concertina of said at least one side wall includes at least two troughs and a ridge intermediate of two troughs, formed in said at least one side wall and the at least two troughs and the ridge extend in a direction between said flange and said basal wall.

10. The container as claimed in claim 1, wherein said region of concertina of said at least one side wall includes a series of ridges and troughs extending in a direction between said flange and said basal wall.

11. The container as claimed in claim 9, wherein each said trough extends from said basal wall towards said flange and is terminated by a web that transitions the at least one side wall between said trough and said flange.

12. The container as claimed in claim 11, wherein each said web is a planar triangular web with one base side parallel to said flange and one apex in the trough.

13. The container as claimed in claim 12, wherein each said web is a planar triangular web with one base side parallel to and contiguous said flange and one apex in the trough.

14. The container as claimed in claim 9, wherein said trough is one defined by said at least one side wall to extend towards said containment region.

15. The container as claimed in claim 1, wherein said flange includes a zone of weakness to allow for a fracturing of the flange.

16. The container as claimed in claim 7, wherein said concertina of said side walls meet at said basal wall.

17. The container as claimed in claim 6, wherein said other pair side walls are planar sidewalls.

18. A set of containers, wherein each container having an upper portion and a lower portion, each container comprising:

a containment region including at least one side wall defining a pair of opposed side wall regions extending between the upper portion and the lower portion, and a basal wall at the lower region of the container;

an upper opening at least partially surrounded by a flange disposed at the upper portion at an end of said at least one side wall distal from said basal wall; and a plurality of pre-formed compaction enabling features at each of said at least one side wall and said basal wall reducing resistance to compression of said lower portion compared to said upper portion, readily enable compaction of said lower portion compared to said upper portion such that, upon compression, said compaction enabling features are configured to substantially completely compact said basal wall to bring at least a lower region of said opposed side wall regions substantially adjacent to one another upon squeezing of said opposed side wall regions;

said compaction enabling features including at least one surface relief on said basal wall and a region of concertina in said side wall;

said region of concertina extending from said basal wall upwards towards said flange.

19. The set of containers as claimed in claim 18, wherein the set of containers is integrally formed in an injection moulding, vacuum forming, rotary moulding or blow moulding process.

20. The set of containers as claimed in claim 18, wherein the set of containers is formed from a single sheet of material in a deep drawing thermoforming machine.

* * * * *